United States Patent [19]

Hisamoto et al.

[11] 4,428,851

[45] Jan. 31, 1984

[54] VOLATILE OIL COMPOSITIONS FOR METAL WORKING

[75] Inventors: Iwao Hisamoto, Suita; Chiaki Maeda, Kyoto; Yukio Omure, Takatsuki, all of Japan

[73] Assignee: Daikin Kogyo Co., Ltd., Osaka, Japan

[21] Appl. No.: 326,186

[22] Filed: Dec. 1, 1981

[30] Foreign Application Priority Data

Dec. 5, 1980 [JP] Japan ..... 55-172214

[51] Int. Cl.[3] ..... C10M 1/30

[52] U.S. Cl. ..... 252/58; 72/42; 252/52 A; 252/52 R

[58] Field of Search ..... 252/58, 52 R, 52 A; 72/42

[56] References Cited

U.S. PATENT DOCUMENTS 3,862,860 1/1975 Pardee et al. ..... 252/58

3,998,989 12/1976 Pardee et al. ..... 252/58

*Primary Examiner*—Jacqueline V. Howard

*Attorney, Agent, or Firm*—Buell, Blenko, Ziesenheim & Beck

[57] ABSTRACT

A volatile oil composition for use in metal working comprising a base oil and at least one halogenated hydrocarbon.

9 Claims, No Drawings

VOLATILE OIL COMPOSITIONS FOR METAL WORKING

This invention relates to volatile oil compositions for metal working and more particularly to volatile lubricant oil compositions for use in processing, machining or temporarily lubricating metal materials.

Conventional lubricant oil compositions for metal working are all nonvolatile and thus, when used, will remain on the surface of the metal product after the completion of the mechanical treatment, consequently necessitating the removal of oil from the surface, thereof by washing.

The principal object of the present invention is to provide volatile lubricant oil compositions for metal working (hereinafter referred to as "volatile metal working oil compositions").

Another object of the invention is to provide volatile metal working oil compositions which exhibit outstanding properties in use for the processing of metal materials.

A further object of the invention is to provide metal working oil compositions which are volatile and which have a cooling ability and lubricity and act as an extreme pressure lubricant.

A further object of the invention is to provide volatile metal working oil compositions having a lubricity and cooling ability sufficient to give reduced friction to metal materials, thereby providing the finished surface of metal product with improved smoothness and the prolongation of tool life.

The above and other objects of the invention will become more apparent from the following description of the invention.

These objects of the invention are achieved by incorporating into a base oil a halogenated hydrocarbon having a boiling point in a specific range enough to volatilize.

The volatile metal working oil compositions of this invention have the feature of being volatilized when left to stand at room temperature and normal pressure for 24 hours. The halogenated hydrocarbon component of the present oil composition are liquids having a boiling point of up to 125° C., preferably in the range of 35° to 125° C. Such halogenated hydrocarbon component acts mainly to cool the surface of metal products.

Typical of useful halogenated hydrocarbons are methylene chloride, perchloroethylene, tetrachlorodifluoroethane, trichlorotrifluoroethane, tetrachloromonofluoroethane, trichlorodifluoroethane, tetrachlorotetrafluoropropane or mixtures of these two or more hydrocarbons. Among such halogenated hydrocarbons, those having at least one fluorine molecule are especially preferred because due to their low surface energy, they readily penetrate into the surface of metal products.

Base oils useful in this invention are those having a boiling point of up to 250° C. Examples of useful base oils are saturated or unsaturated aliphatic hydrocarbons, aromatic hydrocarbons, naphthene hydrocarbons, alkyl ethers of alkylene glycol and the like. Useful saturated or unsaturated aliphatic hydrocarbons include n-decane, dodecan, turpentine oil and pine oil. Exemplary of useful aromatic hydrocarbons is cymene. Examples of useful naphthene hydrocarbons is dicyclohexyle.

The base oils of the present invention are those containing a fluoro oil.

Useful fluoro oils are oil liquids having a boiling point of up to 250° C., preferably 130° to 250° C. Examples of useful fluoro oils are telomers containing, as a taxogen, fluoro olefine such as tetrafluoroethylene and trifluorochloroethylene. Particularly preferred fluoro oils are telomers containing chlorotrifluoroethylene having the formula $$Cl\text{-}CF_2\text{-}(CFCl)_n Cl$$

wherein n is an integer of 2 to 4.

With this invention, it is preferable to use such fluoro oil conjointly with at least one of the other base oils above examplified. The fluoro oil when mixed with any one of the other base oils can synergistically give reduced friction to the surface of the metal product, thus contributing to pronounced enhancement of workability.

The amounts of halogenated hydrocarbon and base oil to be used in the present invention are not particularly limited but are widely variable although the use of these materials are restricted to those having the boiling point in the ranges as specified above. Usually the base oil is used in an amount of 20 to 200 parts by weight per 100 parts by weight of the halogenated hydrocarbon. When conjointly used with the other base oils, the fluoro oil is preferably employed in an amount of about 5 to about 50 parts by weight per 100 parts by weight of the halogenated hydrocarbon.

The volatile metal working oil compositions of this invention may have incorporated therein conventional additives such as a load-resisting additive. Useful load-resisting additives are those having a boiling point of up to 250° C., such as phosphates, fatty acid esters and alkylene glycol esters. Typical of these esters are trimethylphosphate, triethylphosphate, tripropylphosphate and like triphosphates; dimethylhydrogenphosphite or like diphosphites; ethylcaproic acid ester, ethylcaprylic acid ester, ethylcapric acid ester and like fatty acid esters; and polyethyleneglycolmethylether acetate, ethyleneglycolmonoethylether acetate and like alkyleneglycol esters.

The oil compositions of the present invention are advantageously used as aerosols as well as liquids. They are useful, for example, in machining aluminium or stainless steel materials, making holes in printed circuits, reaming, tapping, thread chasing and being used as a lubricant in the assembling involving insertions or slidings, and in like metal working.

The present invention will be hereinafter described in more detail with reference to the examples and comparative examples given below.

EXAMPLES 1-4 AND COMPARATIVE EXAMPLES 1-5

Samples of the present invention were prepared from the halogenated hydrocarbons, base oils and fluoro oils as another base oil in the proportions as listed in the table below.

On the other hand, comparative samples were prepared by using the halogenated hydrocarbons, base oils or fluoro oil each singly or in admixture.

These two groups of samples were tested by being each applied to metal test pins which then were fixed in a tester for checking FALEX lubricants. The tester were subsequently operated to rotate the test pins with use of a specific load over a specified period of time. Eventually the test pins were evaluated in terms of the amount of the metal material abraded away and coefficient of friction. The table below shows the results.

TABLE

| | Volatile metal working oil compositions | | Amount of | |
|---|---|---|---|---|
| | Kind of Components | Percentage (volume) | material abrasion (mg) | Friction coefficient |
| Ex. 1 | Flon 112/Fluoro oil/ n-Decane | 80/10/10 | 0.4 | 0.106 |
| Ex. 2 | Flon 112/n-Decane | 80/20 | 1.3 | 0.120 |
| Ex. 3 | Flon 112/Fluoro oil/ n-Decane/dimethyl phosphite | 80/10/8/2 | 1.0 | 0.113 |
| Ex. 4 | Flon 112/Flon 113/ Fluoro oil/n-Decane | 40/40/10/10 | 0.7 | — |
| Comp. Ex. 1 | Flon 112 | | 22.2 | 0.191 |
| Comp. Ex. 2 | Fluoro oil | | 133.7 | 0.267 |
| Comp. Ex. 3 | Spindle oil | | Rotation of pin stopped due to seizure | |
| Comp. Ex. 4 | n-Decane | | Unmeasured due to great abrasion | |
| Comp. Ex. 5 | Fluoro oil/n-Decane | 80/20 | 140.5 | 0.257 |

Flon 112: Tetrachlorodifluoroethane
Flon 113: Trichlorotrifluoroethane

The fluoro oil used in Comparative Example 2 has the formula

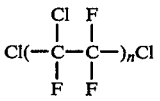

wherein n is an integer of 2.

The tests were carried out under the following conditions in the foregoing examples and comparative examples.

| | |
|---|---|
| Metal Test Piece | FALEX TEST PIN (SAE 3135 STEEL) and VEE BLOCK (AISI 1137 STEEL) |
| Load | 900 lb |
| Operating time | 5 min. |
| Amount of oil used | 70 ml |

The table above shows that the oil compositions of the present invention were low in friction coefficient and amount of abraded metal material, and thus remarkably outstanding in lubricating properties.

We claim:

1. A volatile oil composition for use in metal working which does not remain on the surface of metal product after completion of mechanical treatment, comprising:

(i) a base oil having a boiling point up to 250° C. and selected from the group consisting of saturated or unsaturated aliphatic hydrocarbons, aromatic hydrocarbons, naphthene hydrocarbons and alkyl ethers of alkylene glycol, and (ii) at least one liquid halogenated hydrocarbon having a boiling point of 35° to 125° C.

2. A composition as defined in claim 1 in which the halogenated hydrocarbon has a boiling point of 35° to 125° C.

3. A composition as defined in claim 1 in which the halogenated hydrocarbon is chlorofluoro hydrocarbon.

4. A composition as defined in claim 1 in which the base oil has a boiling point in the range of 130° to 250° C.

5. A composition as defined in claim 3 in which the chlorofluoro hydrocarbon is trichlorotrifluoroethane or tetrachlorodifluoroethane.

6. A composition as defined in claim 1 which contains a load-resisting additive having a boiling point of up to 250° C.

7. A composition as defined in claim 6 in which the load-resisting additive is one of the species selected from the group consisting of phosphate, fatty acid ester and alkyleneglycol ester.

8. A composition as defined in claim 3 in which the base oil has a boiling point in the range of 130° to 250° C.

9. A composition as defined in claim 1 in which the halogenated hydrocarbon comprises a fluro oil having the formula $$Cl\text{-}(CF_2\text{-}CFCl)_n\text{-}Cl$$

wherein n is an integer of 2 to 4.

* * * * *

UNITED STATES PATENT AND TRADEMARK OFFICE

CERTIFICATE OF CORRECTION

PATENT NO. : 4,428,851

DATED : January 31, 1984

INVENTOR(S) : Iwao Hisamoto, Chiaki Maeda and Yukio Omure

It is certified that error appears in the above-identified patent and that said Letters Patent is hereby corrected as shown below:

Column 2, line 11, the formula should read as follows:

-- $Cl\{CF_2CFCl\}_nCl$ --.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*